US006516587B1

(12) United States Patent
Chikatani

(10) Patent No.: US 6,516,587 B1
(45) Date of Patent: Feb. 11, 2003

(54) PLASTIC BAG OPENING METHOD

(75) Inventor: Hajime Chikatani, Tsurugashima (JP)

(73) Assignee: Daisey Machinery Co., Ltd., Tsurugashima (JP)

( * ) Notice: Subject to any disclaimer, the term of this patent is extended or adjusted under 35 U.S.C. 154(b) by 105 days.

(21) Appl. No.: 09/634,639

(22) Filed: Aug. 8, 2000

(51) Int. Cl.[7] ..... B65B 43/26

(52) U.S. Cl. ..... 53/459; 53/468; 53/469; 53/492; 53/384.1; 53/385.1

(58) Field of Search ..... 53/459, 468, 469, 53/492, 384.1, 385.1, 570, 571, 572, 573

(56) References Cited

U.S. PATENT DOCUMENTS 3,538,671 A * 11/1970 Wallace ..... 53/459
3,678,652 A * 7/1972 Panasewicz ..... 53/385.1
3,685,252 A * 8/1972 Wouda ..... 53/385.1
3,715,857 A * 2/1973 Fronczak ..... 53/385.1
3,727,374 A * 4/1973 Williams ..... 53/385.1
3,879,918 A * 4/1975 Lerner ..... 53/459
3,889,449 A * 6/1975 Membrino ..... 53/385.1
4,172,349 A * 10/1979 Lipes ..... 53/459
4,567,715 A * 2/1986 Sawa et al. ..... 53/385.1
5,442,898 A * 8/1995 Gabree et al. ..... 53/459
5,743,071 A * 4/1998 Wolthuizen ..... 53/385.1
5,802,817 A * 9/1998 Hood ..... 53/459

* cited by examiner

*Primary Examiner*—John Sipos
*Assistant Examiner*—Louis Huynh
(74) *Attorney, Agent, or Firm*—Oblon, Spivak, McClelland, Maier & Neustadt, P.C.

(57) ABSTRACT

Plastic bag opening method enables to open plastic bags, one by one, without tearing at pin hole portion, where each plastic bag has one edge of opening portion elongated and the plastic bags are held together with pin being inserted into the pin holes. Lower edge (2) of opening portion (0) of plastic bag (1) is elongated and two pin holes (3) are formed there. Pin (4) is inserted into the pin holes (3) and the plastic bags (1) are held together in multi-layer state, Holding member (5) presses the edge (2) portion between the pin holes (3). In this state, air (7) is blown from air nozzle (6) to open partially the opening portion (0) of the plastic bag (1). Opening member (9) is inserted thereinto to enlarge the opening. The edge (2) is released from the pin (4) without being torn.

4 Claims, 4 Drawing Sheets

PLASTIC BAG OPENING METHOD

BACKGROUND OF THE INVENTION

1. Field of the Invention

The present invention relates generally to a bag opening method and more particularly to a plastic bag opening method for opening plastic bags, one by one, where each of the bags has one edge of its opening portion elongated, the edge so elongated is provided with two pin holes and a multiplicity of the bags are held together in a multi-layer state with a pin being inserted into the pin holes.

2. Description of the Prior Art

In a packaging device for making packages by filling goods in plastic bags for packaging purpose, it is necessary to open the bags, one by one, out of a multiplicity of the bags held together in a multi-layer state. In order to facilitate operation to open the bags, one by one, out of the multi-layered bags for packaging purpose, it is so done conventionally, as shown in FIG. 5, that a bag 01 is formed having one edge 02 of its opening portion elongated, the edge 02 so elongated is provided with two pin holes 03, a pin 04 is inserted into the pin holes 03 so that a multiplicity of the bags 01 are held together in a multi-layer state and the bags 01 in the multi-layer state are opened, one by one, so that goods may be filled therein.

When the bags 01 held with the pin 04 being inserted into the pin holes 03, as shown in FIG. 5, are opened, one by one, to be used for packaging, each of the bags 01 so opened must be released from the pin 04. Conventionally, it is so done that while the pin 04 is inserted into the pin holes 03, goods are filled in the bag 01 and the bag 01 at the portion of the pin holes 03 is torn off by a force acting at the time of packaging or the like.

In this case, even though the bag 01 is torn off at the portion of the pin holes 03, as the plastic bag or the like has a considerable tensile strength, there is provided a perforated line or cut portion 05 in the portion of the pin holes 03 so that the bag 01 may be torn off easily at the portion of the pin holes 03. But, if the perforated line or cut portion 05 is made excessively, the bag 01 will be immediately torn off so that goods filling operation may be obstructed, or if the perforated line or cut portion 05 is made insufficiently, the bag 01 will be hardly torn off so that goods filling operation may be also obstructed.

Thus, in the prior art where each of the bags 01 has one edge 02 of its opening portion elongated, the edge 02 is provided with the two pin holes 03 and the multiplicity of the bags 01 are held together with the pin 04 being inserted into the pin holes 03, there has been a considerable difficulty in the operation to open the bags 01, one by one, so as to fill goods therein.

Also, even if the bag 01 is torn off well at the portion of the pin holes 03, there are often remaining torn fractions in the portion of the pin holes 03 of the bag 01 so torn off and by such bag 01, no good outside appearance of the packaged commercial goods is obtained, which has been a large problem in the bag package of this type.

SUMMARY OF THE INVENTION

It is therefore an object of the present invention to provide a plastic bag opening method for opening plastic bags, one by one, without tearing them at the portion of pin holes, where each of the bags has one edge of its opening portion elongated, the edge so elongated is provided with two pin holes and a multiplicity of the bags are held together with a pin being inserted into the pin holes.

In order to attain the mentioned object, the present invention provides a plastic bag opening method for opening plastic bags, one by one, where each of the plastic bags has one edge of its opening portion elongated, the edge so elongated is provided with two pin holes and the plastic bags are held together with a pin being inserted into the pin holes, characterized in comprising steps of; causing a pin, having its upper end free, to be inserted into the pin holes so as to hold the plastic bags together; while pressing the edges so elongated of the plastic bags at a portion between the two pin holes, blowing air from obliquely above toward an opening portion of a plastic bag of the top of the plastic bags so as to form an opening of the plastic bag; and inserting an opening member into the opening of the plastic bag so as to enlarge the opening.

In the plastic bag opening method according to the present invention, where each of the plastic bags has one edge of its opening portion elongated and the edge so elongated is provided with the two pin holes, the edges of the plastic bags, lapped one on another in a multi-layer state, are pressed at the portion between the two pin holes and air is blown from obliquely above toward the opening portion of the plastic bag of the top of the multi-layered plastic bags, hence the plastic bag of the top is opened partially to form an opening as it is held in the multi-layer state.

Then, the opening member, which is enlargeable upward/downward and/or rightward/leftward, is inserted into the opening so formed to enlarge the opening and the edge so elongated on the lower side of the plastic bag is lifted up, except the portion so pressed between the two pin holes, thereby the edge at the portion of the pin holes comes out of the pin which has its upper end free.

DESCRIPTION OF THE PREFERRED EMBODIMENTS

Figure 1:
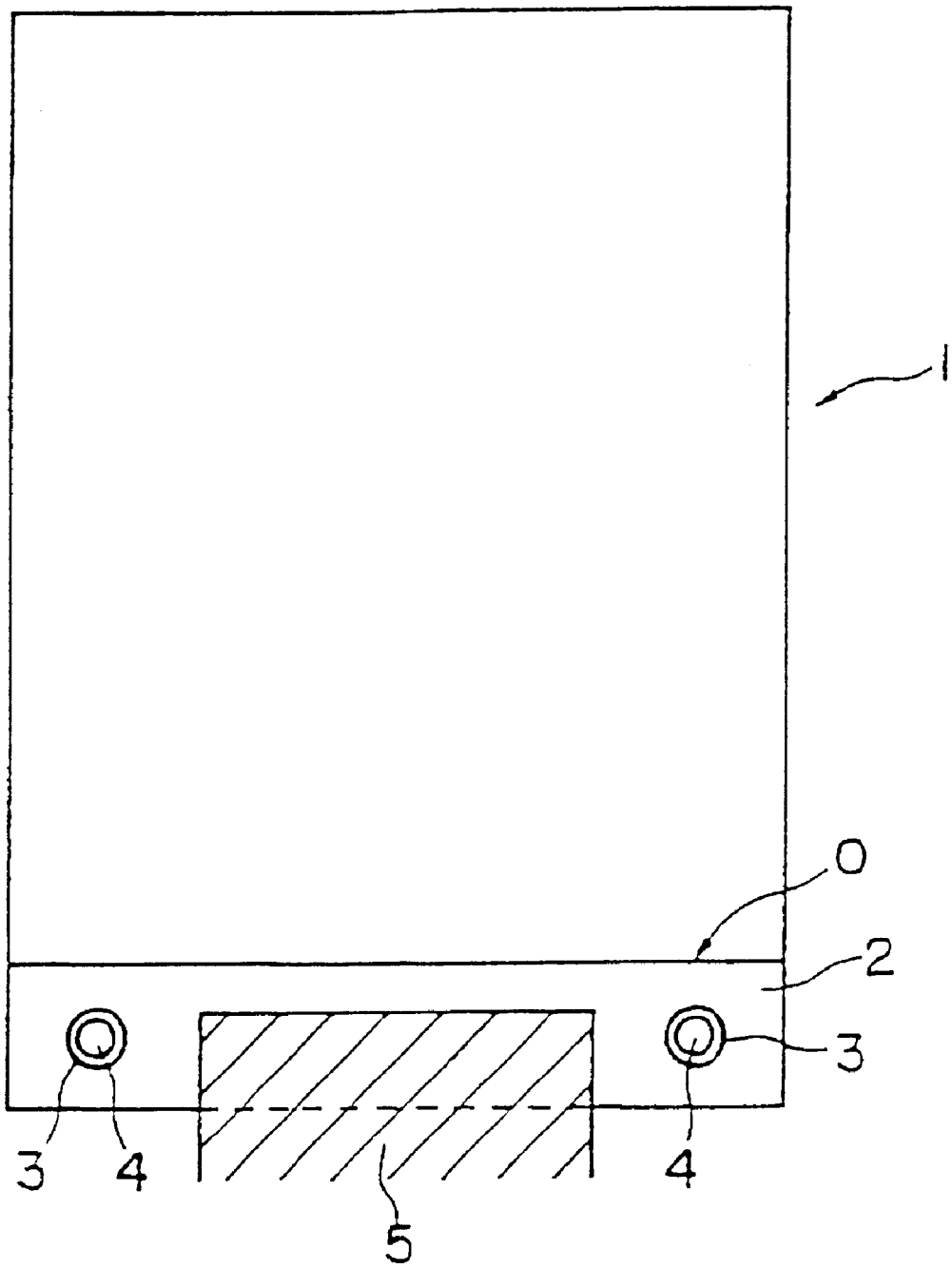
FIG. 1 is a plan view showing plastic bags held together in a multi-layer state so that a plastic bag opening method according to the present invention may be applied.

Herebelow, a plastic bag opening method according to the present invention will be described based on an embodiment shown in FIGS. 1 to 4. In FIGS. 1 to 4, numeral 1 designates a plastic bag for packaging purpose, of which periphery is closed, except the portion of an opening portion 0. One edge 2 of the opening portion 0, that is, a lower edge of the opening portion 0 in FIG. 1, is elongated and the edge 2 so elongated is provided with two pin holes 3 which are arranged with a predetermined interval between them.

A multiplicity of the plastic bags 1, each being so formed, are lapped one on another in a multi-layer state and are held together with two pins 4, each having its upper end free, being inserted into the pin holes 3. The multi-layered plastic bags 1 are pressed by an appropriate holding member 5 at a portion between the pin holes 3 of the edge 2 so elongated.

Figure 2:
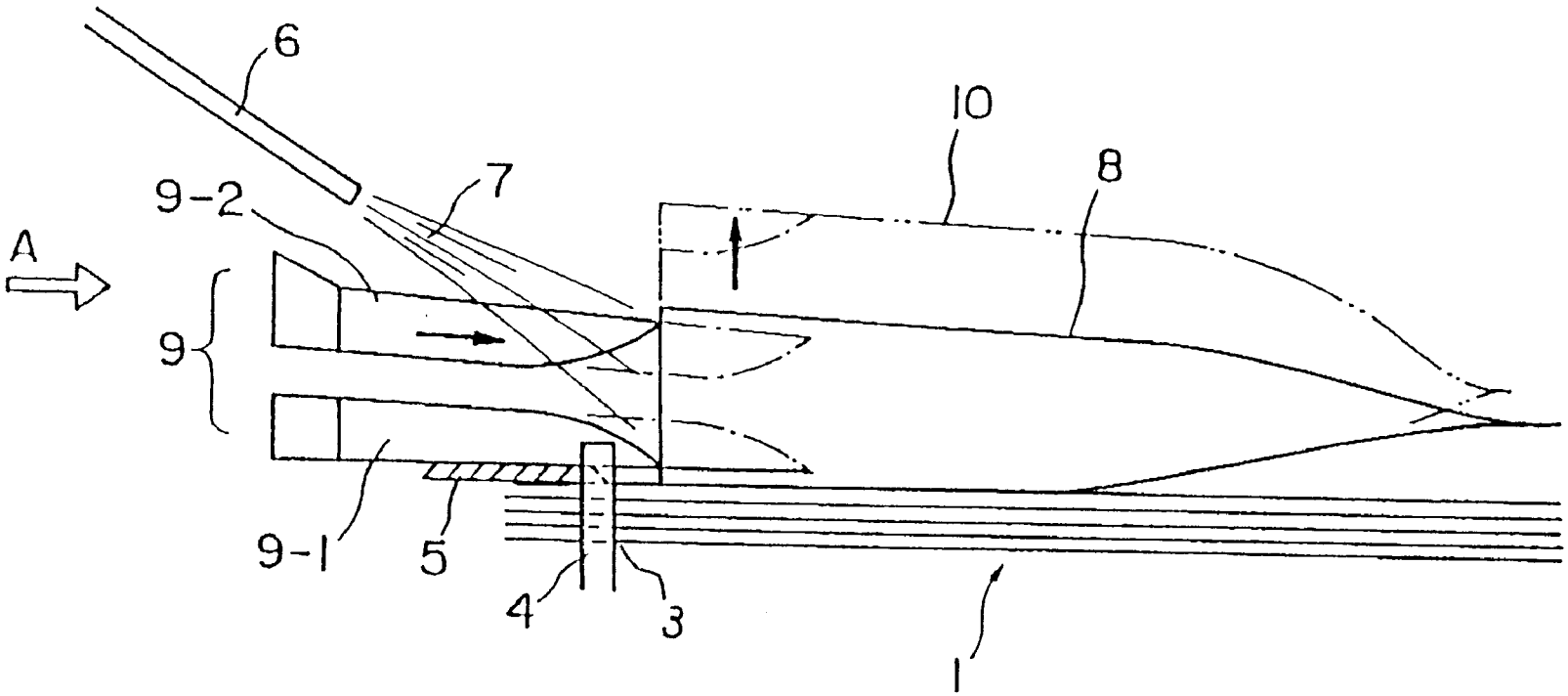
FIG. 2 is an explanatory side view showing a state where the plastic bag opening method according to the present invention is being applied to the plastic bags shown in FIG. 1.
Figure 3:
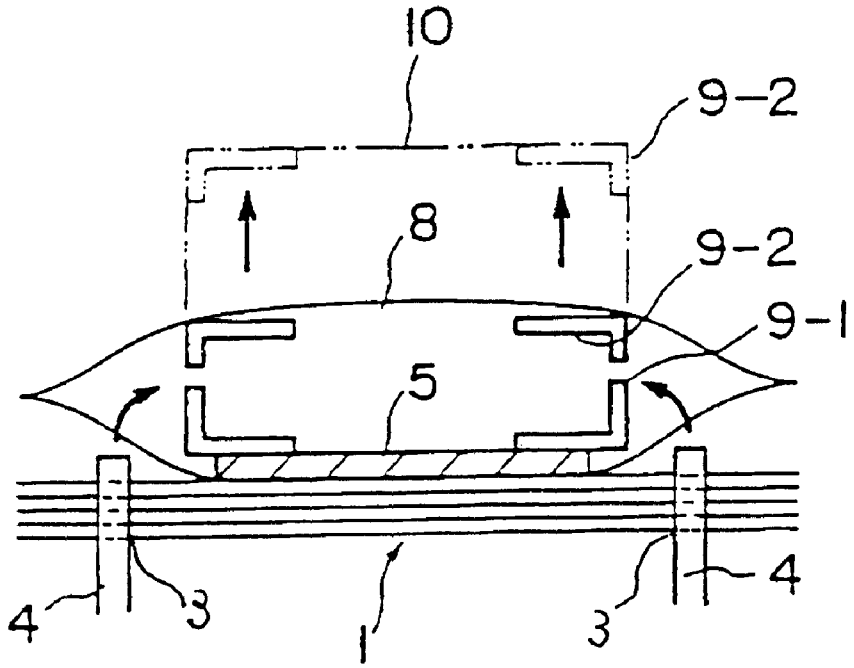
FIG. 3 is an explanatory front view seen from arrow A of FIG. 2.
Figure 4:
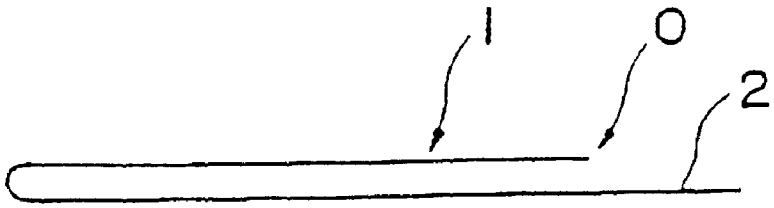
FIG. 4 is a cross sectional view of one of the plastic bags shown in FIG. 1.
Figure 5:
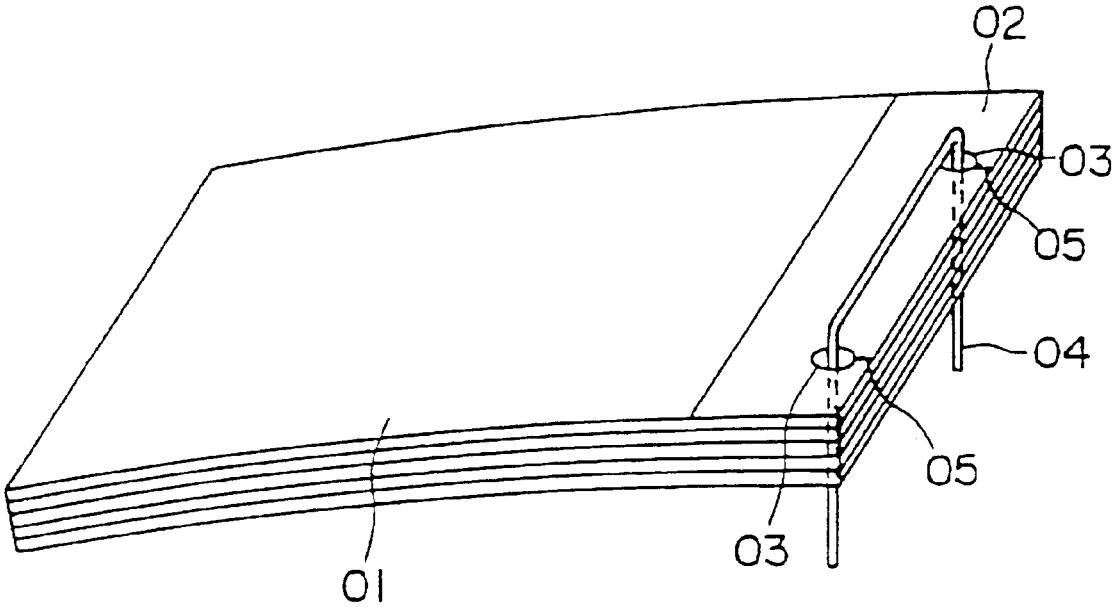
Fig. 5 (Prior Art)
FIG. 5 is a perspective view showing a plastic bag opening method in the prior art.

An air nozzle 6 is disposed obliquely above the plastic bags 1 so held in the multi-layer state and when air 7 is blown from the air nozzle 6 toward the opening portions 0 of the plastic bags 1, the opening portion 0 of the plastic bag 1 on the top is opened as shown by solid lines 8 of FIGS. 2 and 3.

Then, an opening member 9 is inserted into an opening so formed by the air 7 blown from the air nozzle 6. The opening member 9 comprises four bars of lower bars 9-1 (two pieces) and upper bars 9-2 (two pieces) and these four bars are so constructed that a space between the lower bars 9-1 and the upper bars 9-2 may be enlarged or contracted.

The opening member 9 is first inserted into the opening of the plastic bag 1 and then the upper bars 9-2 are moved upwardly to enlarge the opening of the plastic bag 1, as shown by virtual lines 10. By the action of the air 7 to open the plastic bag 1 partially and by the action of the opening member 9 to enlarge the opening, the edge 2 at the portion of the pin holes 3, into which the pins 4 are inserted, comes out of the pins 4, which have their upper ends free, and in no case the edge 2 is torn at the portion of the pin holes 3.

Thus, after the plastic bag 1 is opened to the maximum by the opening member 9, goods to be packaged are filled in the plastic bag 1 through the opening.

It will be preferable if a pressing force of the holding member 5 is weakened at an appropriate time of before, while or after filling the goods in the bag 1, so that the bag 1 on the top so opened may be released from the multi-layer state.

Also, as for the opening member 9 to be inserted into the opening of the bag to be opened, it may be constructed variously, for example, to enlarge the opening upward/downward, rightward/leftward or upward/downward and rightward/leftward, so as to be selected appropriately according to shape, size or the like of the bag to be opened.

While the invention has been described concretely based on the embodiment as illustrated, the invention is not limited to the described embodiment but, needless to mention, may be added with various modifications in the particular structure and construction thereof as come within the scope of the appended claims.

For example, while, in the mentioned embodiment, the opening member 9 has been illustrated and described as being constructed such that the upper bars 9-2 move upwardly to enlarge the opening of the bag 1, the opening member 9 may be constructed such that the four bars 9-1, 9-2 move obliquely upwardly or obliquely downwardly with an angle of 45°, respectively, to enlarge the opening of the bag 1 and the point therefor is that a known one as the opening member of this kind may be employed appropriately.

As mentioned above, the present invention provides the plastic bag opening method for opening plastic bags, one by one, where each of the plastic bags has one edge of its opening portion elongated, the edge so elongated is provided with two pin holes and the plastic bags are held together with a pin being inserted into the pin holes, characterized in comprising steps of; causing a pin, having its upper end free, to be inserted into the pin holes so as to hold the plastic bags together; while pressing the edge so elongated of the plastic bags at a portion between the two pin holes, blowing air from obliquely above toward an opening portion of a plastic bag of the top of the plastic bags so as to form an opening of the plastic bag; and inserting an opening member into the opening of the plastic bag so as to enlarge the opening.

According to the plastic bag opening method of the present invention, the plastic bag is opened while the elongated edge of the plastic bag opening portion is being pressed between the two pin holes and the edge at the portion of the pin holes is released from the pin in the course of the bag opening, hence the bag can be opened without being torn off at the portion of the pin holes.

Thus, according to the plastic bag opening method of the present invention, a bag package having no torn portion in the opening portion can be produced.

What is claimed is:

1. A plastic bag opening method for opening plastic bags in a stack, one by one, where each of said plastic bags has a first edge of its opening portion elongated and extending past a second edge, said first elongated edge lying below said second edge and is provided with two pin holes and said plastic bags are held together with pins being inserted into said pin holes of said plastic bag, said plastic bag opening method comprising steps of:

inserting two pins, having upper ends free, into said pin holes of said plastic bags to hold said plastic bags together in a stack to be released one by one;

pressing said elongated edges of said plastic bags at a portion between said two pin holes, and simultaneously blowing air from an oblique angle above toward an opening portion of a top plastic bag to form an opening of said top plastic bag; and inserting an opening member into said opening of said top plastic bag to enlarge said opening so that said pin holes pass over said free ends of said pins by action of the air blowing or action of said opening member without tearing said top plastic bag at the portion of said pin holes.

2. A plastic bag opening method according to claim 1, further comprising the step of;

weakening said pressing of said elongated first edge.

3. A plastic bag opening method as claimed in claim 1, wherein said opening member comprises upper and lower bars and said upper bar is constructed movable upwardly and downwardly.

4. A plastic bag opening method as claimed in claim 1, wherein said opening member comprises upper and lower bars, in two pieces each, and each of said bars is constructed movable obliquely upwardly and obliquely downwardly.

* * * * *